US007918708B2

(12) United States Patent
Kowalski

(10) Patent No.: US 7,918,708 B2
(45) Date of Patent: Apr. 5, 2011

(54) ILLUMINATED MAGNETIC MODULE FOR TOY CONSTRUCTION KIT

(75) Inventor: Charles J. Kowalski, Ridgewood, NJ (US)

(73) Assignee: MEGA Brands International, Luxembourg, Zug Branch (CH)

( * ) Notice: Subject to any disclaimer, the term of this patent is extended or adjusted under 35 U.S.C. 154(b) by 1288 days.

(21) Appl. No.: 11/474,396

(22) Filed: Jun. 26, 2006

(65) Prior Publication Data

US 2007/0010164 A1 Jan. 11, 2007

Related U.S. Application Data

(60) Provisional application No. 60/696,839, filed on Jul. 6, 2005.

(51) Int. Cl.
*A63H 33/04* (2006.01)

(52) U.S. Cl. ..... 446/85; 446/129; 446/175; 446/484

(58) Field of Classification Search ..... 446/129, 446/130, 132, 137, 124, 85, 91, 175, 484; 434/190; *A63H 33/04*
See application file for complete search history.

(56) References Cited

U.S. PATENT DOCUMENTS

| | | | | |
|---|---|---|---|---|
| 3,102,362 | A * | 9/1963 | Neal | 446/129 |
| 3,768,178 | A * | 10/1973 | Glassman | 434/190 |
| 4,317,461 | A * | 3/1982 | Anderson | 132/233 |
| 5,295,889 | A * | 3/1994 | Ejima | 446/91 |
| 6,682,202 | B2 * | 1/2004 | Wong | 362/118 |
| 6,857,755 | B1 * | 2/2005 | Lewis | 362/104 |
| 2005/0118925 | A1 * | 6/2005 | Kretzschmar | 446/124 |
| 2005/0118926 | A1 * | 6/2005 | Roger | 446/137 |

OTHER PUBLICATIONS

International Search Report Dated Feb. 16, 2007.

* cited by examiner

*Primary Examiner* — Dmitry Suhol
*Assistant Examiner* — Alex F. R. P. Rada, II
(74) *Attorney, Agent, or Firm* — Plumsea Law Group, LLC

(57) ABSTRACT

An embodiment of the invention provides a toy construction kit comprising a light element and a construction element. The light element comprises a housing having a first end and a second end, the housing defining a compartment, a magnet disposed in the compartment at the first end, and a printed circuit board disposed at the second end of the housing, the printed circuit board having an illumination device mounted on its side opposite to the compartment. The construction element is held to the light element by a magnetic attractive force between the magnet at the first end of the light element and the construction element.

22 Claims, 5 Drawing Sheets

ILLUMINATED MAGNETIC MODULE FOR TOY CONSTRUCTION KIT

This application claims the benefit of U.S. Provisional Application No. 60/696,839, filed Jul. 6, 2005, which is herein incorporated by reference in its entirety.

BACKGROUND

1. Field of the Invention

The present invention is directed generally to puzzles and toys. More particularly, the present invention is directed to three-dimensional toy construction assemblies made from magnetic structural components and/or magnetic illumination components that are magnetically and/or mechanically coupled together.

2. Background of the Invention

Individuals often find enjoyment in the challenge of building aesthetic structural designs and/or functional structural models. Frequently, the utility associated with constructing such structures is found in the creative and/or problem solving process required to achieve a desired structural objective. Currently, construction assemblies that exploit magnetic properties to interlink various structural components and thereby form different two and/or three dimensional structures are known and can provide an added dimension of sophistication to the construction process. For example, flat shapes such as triangular, square, or rectangular plates in which magnets are inserted can be attached to steel balls to create a number of three-dimensional shapes.

Some magnetic construction assemblies can only be assembled in certain configurations. Thus, there remains a constant need for magnetic construction assemblies that provide construction flexibility and increased visual interest.

This and other needs are addressed by the present invention. Additional advantageous features and functionalities of the present invention will be apparent from the disclosure which follows, particularly when reviewed in conjunction with the accompanying drawings.

BRIEF SUMMARY OF THE INVENTION

An embodiment of the present invention provides a magnetic light assembly configurable in a wide variety of structural profiles, thereby increasing construction flexibility and the visual interest of the constructions. The magnetic light assembly of this embodiment of the present invention advantageously interacts with at least one complementary ferromagnetic or magnetic structural component via magnetic and/or mechanical connection to form a variety of different structural profiles having enhanced visual interest.

BRIEF DESCRIPTION OF THE DRAWINGS

For a better understanding of the present invention, reference is made to the following detailed description of various exemplary embodiments considered in conjunction with the accompanying drawings, in which.

DETAILED DESCRIPTION OF THE INVENTION

Figure 1:
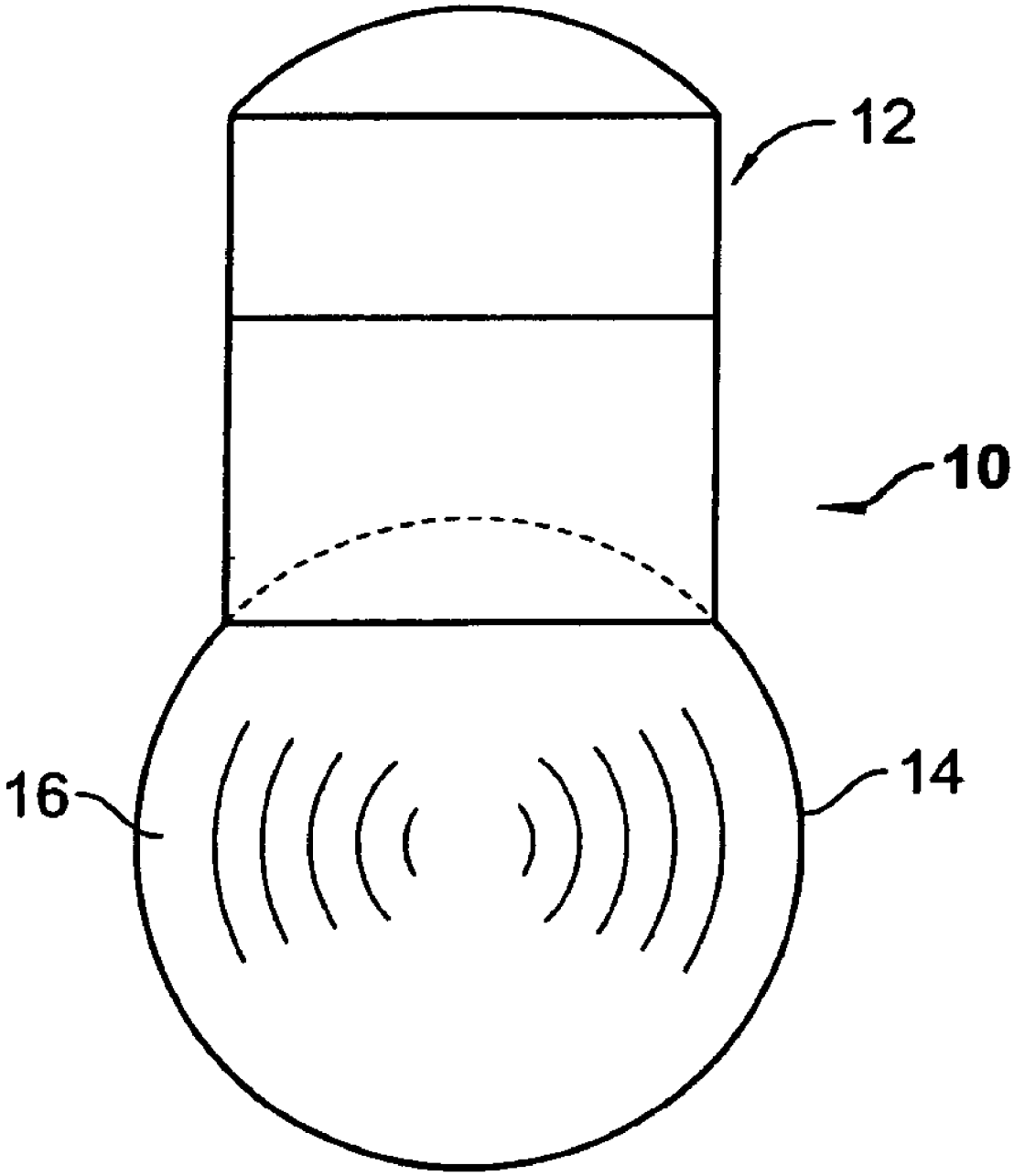
FIG. 1 is a schematic diagram of a side elevation view of an inventive toy construction formed in accordance with one exemplary embodiment of the present invention.
Figure 2:
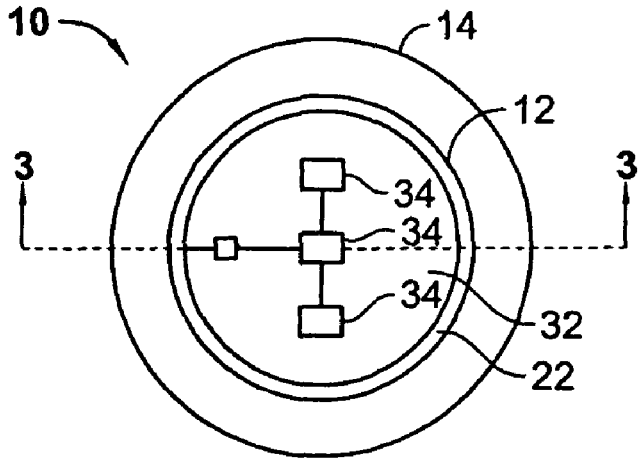
FIG. 2 is a schematic diagram of a top plan view of the toy construction of FIG. 1.
Figure 3:
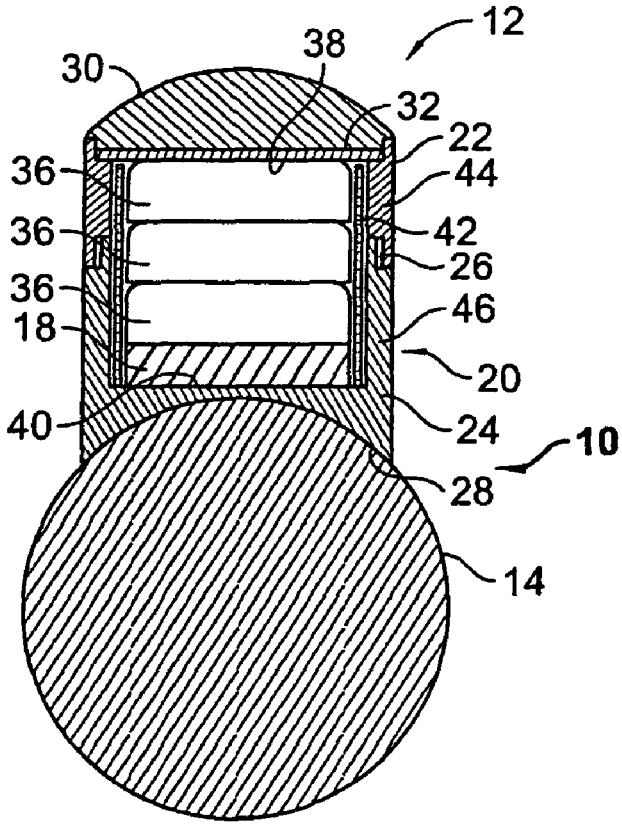
FIG. 3 is a schematic diagram of a cross-sectional view, taken along section line 3-3 of FIG. 2 and looking in the direction of the arrows, of the toy construction of FIG. 1.

Referring to FIGS. 1-3, a toy construction 10 includes a magnetic light assembly 12 and a ferromagnetic sphere 14, which has a spherical outer surface 16. The ferromagnetic sphere 14 is made of ferromagnetic material, such as steel, so that it can be magnetically coupled to and uncoupled from the magnetic light assembly 12, which includes an internally mounted magnet 18 (see FIG. 3), such as a rare earth type magnet that would allow the magnet 18 to have a small size and yet still generate a significant magnetic field.

Referring still to FIGS. 1-3, but with particular reference to FIG. 3, the magnetic light assembly 12 includes a housing 20 formed by upper and lower housing portions 22, 24, respectively, joined together at a joint 26 defined by a threaded connection, or alternatively by a friction fit or by adhesive. A concave surface 28 of the lower housing portion 24 has a curvature that conforms to the curvature of the spherical outer surface 16 of the ferromagnetic sphere 14. Alternatively, the concave surface 28 can be configured as a planar surface. A transparent lens 30, preferably made from a plastic resin or glass, is affixed to the top of the upper housing portion 24. The upper and lower housing portions 22, 24 are made of steel, and are thus electrically conductive.

With particular reference to FIGS. 2 and 3, a printed circuit assembly 32 is mounted within the upper housing portion 22 of the magnetic light assembly 12, immediately beneath the transparent lens 30. Illumination devices, which in this example are light emitting diodes (LEDs) 34, are mounted on the printed circuit assembly 32, along with associated circuitry for illuminating the LEDs 34. An electrical source is disposed in a compartment defined by housing portions 22, 24. In this example, the electrical source is batteries 36 arranged in series between a conductive surface 38 of the printed circuit assembly 32 and a conductive surface 40 associated with the lower housing portion 24. An electrically insulating sleeve 42 is interposed between the batteries 36 and respective side walls 44, 46 of the upper and lower housing portions 22, 24 in order to prevent electrical contact therebetween.

In addition to being physically mounted within the upper housing portion 22, the printed circuit assembly 32 is electrically coupled thereto to provide a return path for a power circuit described more fully below. Such a power circuit (i.e., a power circuit for illuminating the LEDs 34) is formed when the upper housing portion 22 is threaded onto the lower housing portion 24 so as to cause the respective side walls 44, 46 to become electrically mated (e.g., when the portions 22, 24 are fully threaded together), whereby electrical continuity is established between the conductive surface 38 of the printed circuit assembly 32 and the conductive surface 40 of the lower housing portion 24 through the batteries 36. The placement of the magnet 18, being electrically conductive, within the housing 20 maintains the necessary electrical continuity between the lower-most battery 36 and the upward-facing conductive surface 40 of the lower housing 24.

In operation, a strong attractive force is provided by the internally-mounted magnet 18, enabling the magnetic light assembly 12 to be securely magnetically coupled to and uncoupled from the ferromagnetic sphere 14 via contact between the concave surface 28 of the lower housing portion 24 and the spherical outer surface 16 of the ferromagnetic sphere 14. The power circuit, described above, is activated by threading the upper housing 22 onto the lower housing 24, resulting in the LEDs 34 being illuminated. In this regard, it should be understood that the LEDs 34 could be operated in a continuous mode or in a blinking mode. In addition to or alternatively, other means for activating the power circuit can be provided, e.g., a switch.

Numerous modifications and variations to the toy construction 10 can be employed. For example, the magnetic light assembly 12 can have a non-magnetic material for the upper and lower housing portions 22, 24, since a sufficiently strong magnetic connection to the ferromagnetic sphere 14 can be maintained solely via the field generated by the internally mounted magnet 18. As a further example, the ferromagnetic sphere 14 can be made of a plastic core with a coating of magnetic nickel material, such materials being more fully described below.

Figure 4:
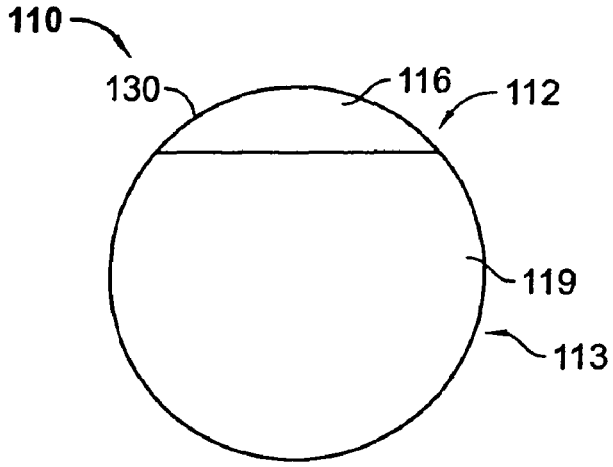
FIG. 4 is a schematic diagram of a side elevation view of a spherical toy construction formed in accordance with another exemplary embodiment of the present invention.
Figure 5:
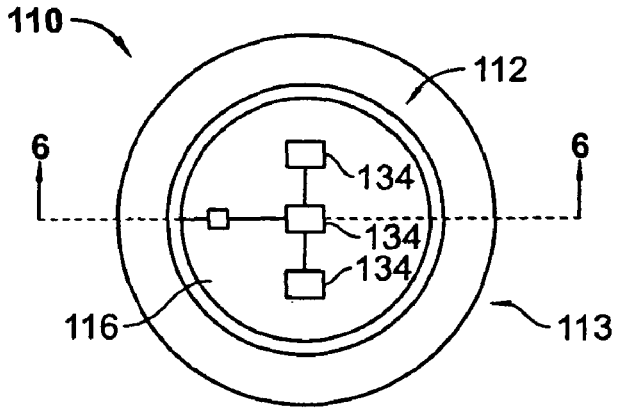
FIG. 5 is a schematic diagram of a top plan view of the spherical toy construction of FIG. 4.
Figure 6:
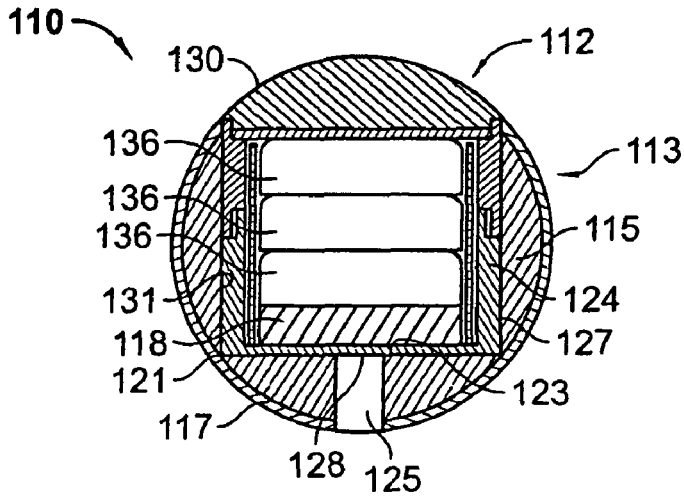
FIG. 6 is a schematic diagram of a cross-sectional view, taken along section line 6-6 of FIG. 5 and looking in the direction of the arrows, of the spherical toy construction of FIG. 5.

Another exemplary embodiment of the present invention is illustrated in FIGS. 4-6. Elements illustrated in FIGS. 4-6 that correspond to the elements described above with reference to FIGS. 1-3 have been designated by corresponding reference numerals increased by one hundred, while new elements are designated by odd numbered reference numerals in the hundreds. The embodiment of the present invention shown in FIGS. 4-6 operates and is constructed in a manner consistent with the embodiment of FIGS. 1-3, unless stated otherwise.

Referring to FIGS. 4-6, a spherical toy construction 110 includes a magnetic light assembly 112 embedded in a partially spherical receptacle 113. The magnetic light assembly 112 is identical to the magnetic light assembly 12 of FIGS. 1-3, except that a downward facing surface 128 of the lower housing 124 is planar, rather than concaved. The receptacle 113 is in the form of a truncated sphere formed from a plastic core 115 and a magnetic nickel coating 117 deposited thereon so as to be coextensive with a spherical outer surface 119 of the receptacle 113. The core 115 includes a cavity 121, which is sized and shaped so as to receive the magnetic light assembly 112 for insertion within the core 115. The cavity 121 includes a bottom surface 123. An access hole 125 extends through the plastic core 115 from the bottom surface 123 of the cavity 121. A transparent lens 130 of the magnetic light assembly 112 includes an outer surface 116 in the form of a spherical sector having a curvature that matches the curvature of the spherical outer surface 119 of the receptacle 113, thereby affording a generally spherical shape to the toy construction 110.

The magnetic light assembly 112 includes a substantially cylindrical outer surface 127, and the cavity 121 includes a substantially cylindrical inner surface 131. The two cylindrical surfaces 127, 131 are dimensioned so as to produce a friction fit between the magnetic light assembly 112 and the receptacle 113 upon insertion of the former into the latter. When the downward facing surface 128 of the magnetic light assembly 112 is brought into contact with the bottom surface 123 of the cavity. 121, the magnetic light assembly 112 will tend to remain lodged in the receptacle 113 unless and/or until it is intentionally dislodged therefrom.

In operation, the magnetic light assembly 112 illuminates the spherical toy construction 110 from within, producing intriguing visual effects. The nickel coating 117 has a silvery reflective appearance that also enhances the attractiveness of the spherical toy construction 110, and increases the potential interest of the user.

The access hole 125 enables the user to dislodge the magnetic light assembly 112 from the cavity 121 for any purpose. For example, the user can change the batteries 136, switch to another magnetic light assembly 112 having LEDs 134 with different colors and/or a different pattern of illumination, and/or store the magnetic light assembly 112 between uses to preserve the energy of the batteries 136 (it being understood that in the assembled state of the spherical toy construction 110, the LEDs 134 of the magnetic light assembly 112 will be in a perpetually energized state until the batteries 136 become exhausted).

Numerous modifications and variations to this construction can be employed. For example, the overall shape of the transparent lens 130 need not be spherical. The transparent lens 130 may include one or more edges or may be cylindrical or conical in shape, at least in part. The receptacle 113 can be a multi-part assembly rather than a one-piece element, and may be made of steel throughout, or of another magnetic material. Alternatively, the receptacle 113 can be made of non-magnetic material since the internal magnet 118 can exert sufficient magnetic attraction, for the purpose of interconnection, in the context of larger assemblies. The magnetic light assembly 112 can be configured so as to fit into the receptacle 113 with, for example, a snap-type fit, a threaded fit, a frictional fit, or adhesive.

Figure 7:
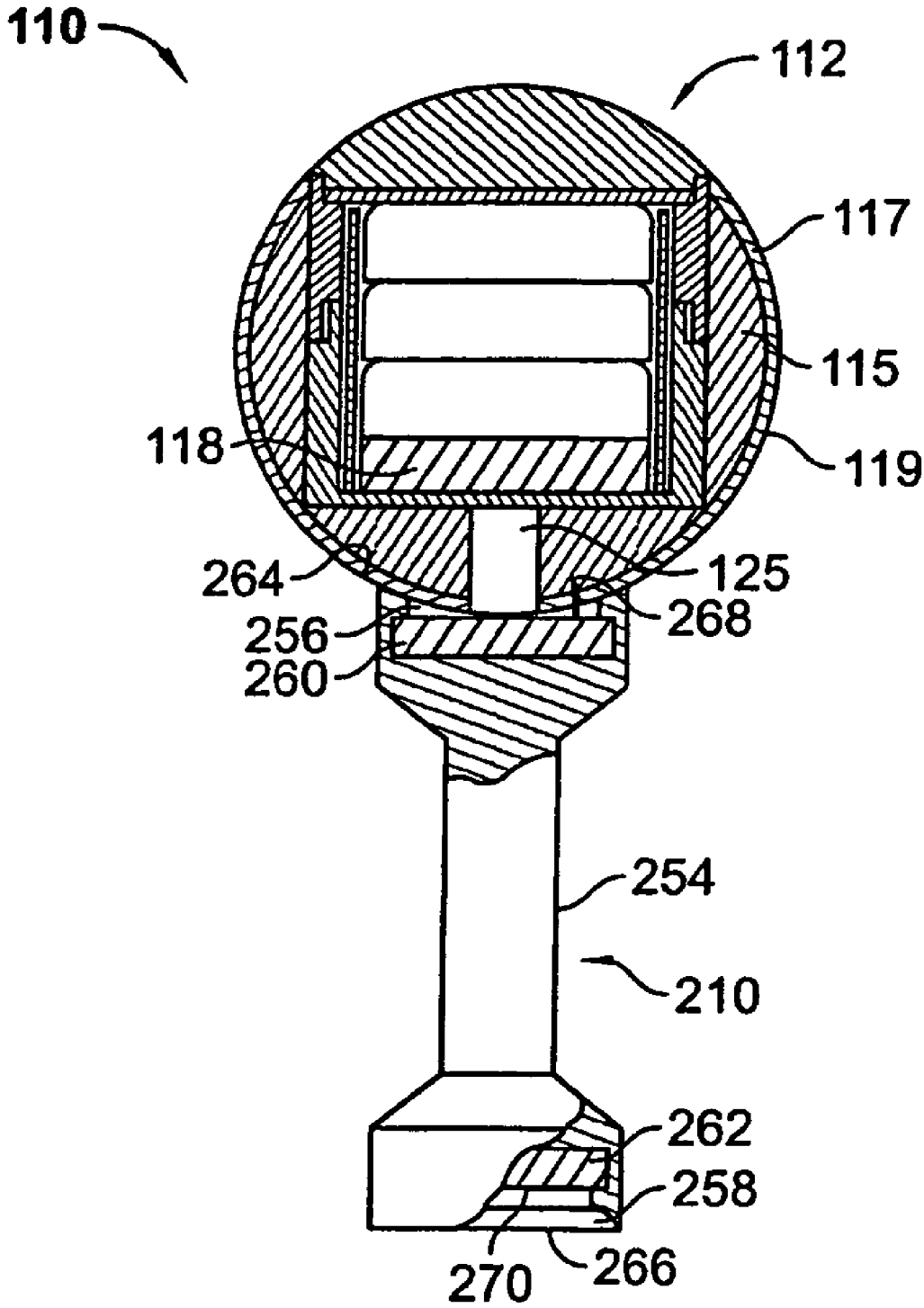
FIG. 7 is a schematic diagram of a partially cross sectioned, side elevation view showing the spherical toy construction of FIGS. 4-6 in combination with a bar-shaped magnetic element.

Referring specifically to FIG. 7, the spherical toy construction 110 is shown in combination with a bar-shaped magnetic element 210. To facilitate consideration and discussion, elements illustrated in FIG. 7 that correspond to the elements described above with reference to FIGS. 4-6 have been designated by corresponding reference numerals, while elements of the bar-shaped magnetic element 210 are designated by reference numerals in the two hundreds. The combination of FIG. 7 operates and is constructed in manners consistent with the foregoing description of the above-described embodiments of the invention, unless stated otherwise.

The bar-shaped magnetic element 210 includes an elongated rod 254 having pockets 256, 258 at each end. Magnets 260, 262 are embedded in the respective pockets 256, 258. Beveled edges 264, 266 are associated with the pockets 256, 258, respectively. The exposed magnetic surfaces 268, 270 of the magnets 260, 262 may have any desired polarity provided the polarity is opposite to that of the magnet 118 contained in the spherical toy construction 110. If the polarity of the magnet 118 needs to be changed, this can be accomplished by disassembling the spherical toy construction 110 and rotating the magnet 118 one hundred and eighty degrees to establish the desired north or south polarity.

In operation, the spherical toy construction 110 and the bar-shaped magnetic element 210 are magnetically coupled such that the magnet 260 of the bar-shaped magnetic element 210 and the magnet 118 of the magnetic light assembly 112 are brought into close proximity. Such an arrangement provides a detachable, but strong, connection between the bar-shaped magnetic element 210 and the spherical toy construction 110. The magnetic nickel coating 117 on the core 115 enhances the magnetic coupling, but is not strictly necessary for same. Being arranged so as to face each other, and so as to be in close proximity to each other, the magnets 118, 260 tend to assume a substantially axially aligned orientation with respect to each other, resulting in the bar-shaped magnetic element 210 and the spherical toy construction 110 being substantially axially aligned at the access hole 125 of the spherical toy construction 110. The beveled edge 264 provides a good seat for the spherical toy construction 110 in the pocket 256, and contributes to a stable frictional connection between the spherical outer surface 119 and the beveled edge 264, such that relative movement therebetween is resisted and axial alignment between the spherical toy construction 110 and the bar-shaped magnetic element 210 is maintained. This permits the user to observe the light that emanates from the spherical toy construction 110 and that projects in a generally longitudinal direction without any obstruction from the bar-shaped magnetic element 210.

Numerous modifications and variations to this construction can be employed. For example, a spherical toy construction 110 may be placed on both ends of the bar-shaped magnetic element 210. If lateral projection of the light emanating from the toy construction 110 is desired, the axis of the access hole 125 of the spherical toy construction 110 may be oriented to be substantially perpendicular to the axis of the bar-shaped magnetic element 210, in which case the nickel coating 117 would be important since the internal magnetic 118 would be misaligned with the magnet 260.

Figure 8:
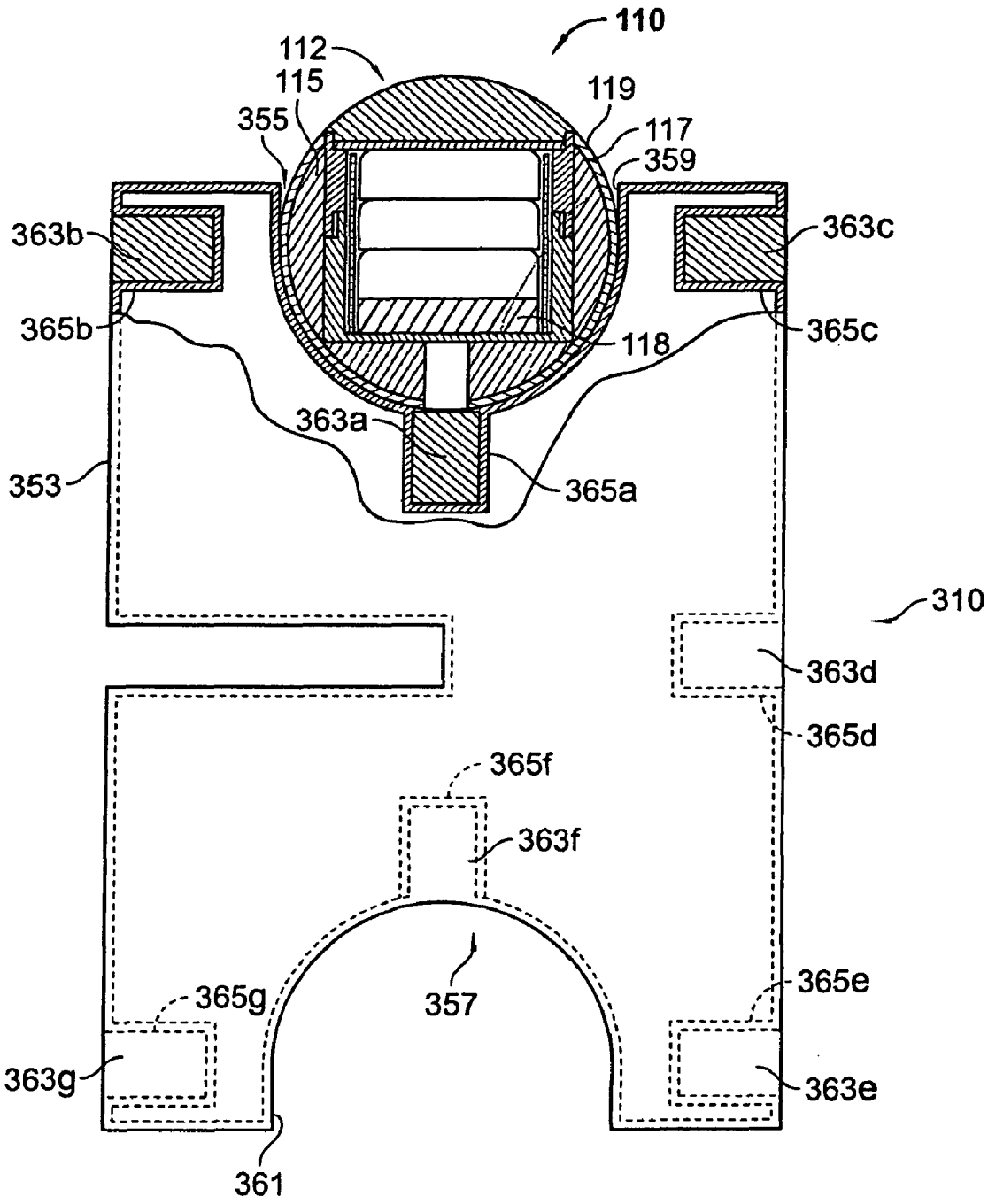
FIG. 8 is a schematic diagram of a partially cross sectioned, side elevation view showing the spherical toy construction shown in FIGS. 4-6 in combination with a panel-shaped magnetic element.

An additional exemplary embodiment of the present invention is illustrated in FIG. 8. Referring specifically to FIG. 8, the spherical toy construction 110 is shown in combination with a panel-shaped magnetic element 310, an example of which is fully described in provisional U.S. Patent Application Ser. No. 60/635,150, filed Dec. 10, 2004, and U.S. patent application Ser. No. 11/297,445, filed Dec. 9, 2005, the contents of which are hereby incorporated by reference in their entirety. To facilitate consideration and discussion, elements illustrated in FIG. 8 that correspond to the elements described above with reference to FIGS. 4-6 have been designated by corresponding reference numerals, while elements of the panel-shaped magnetic element 310 are designated by reference numerals in the three hundreds. The combination of FIG. 8 operates and is constructed in manners consistent with the foregoing description of the above-described embodiments of the invention, unless stated otherwise.

Referring specifically to FIG. 8, the panel-shaped magnetic element 310 includes a substantially planar body 353 having recesses 355, 357 at opposing ends thereof. The recesses are in the form of outward-facing surfaces 359, 361 that are spherically concave. Magnets 363(*a*)-363(*g*) are inserted in corresponding pockets 365(*a*)-365(*g*) of the panel-shaped magnetic element 310. The magnets 363(*a*), 363(*f*) may have any desired polarity provided the polarity is opposite to that of the magnet 118, contained in the spherical toy construction 110. If the polarity of the magnet 118 needs to be changed, this can be accomplished by disassembling the spherical toy construction 110 and rotating the magnet 118 one hundred and eighty degrees to establish the desired north or south polarity.

In operation, the spherical toy construction 110 and the panel-shaped magnetic element 310 are magnetically coupled such that the magnet 363(*a*) of the panel-shaped magnetic element 310 and the magnet 118 of the magnetic light assembly 112 are brought into close proximity, providing a detachable, but strong connection between the panel-shaped magnetic element 310 and the spherical toy construction 110. The magnetic nickel coating 117 on the plastic core 115 enhances magnetic coupling, but is not strictly necessary for same. Being arranged so as to face each other, and so as to be in close proximity to each other, the magnets 118, 363(*a*) tend to assume a substantially axially aligned orientation with respect to each other, resulting in the panel-shaped magnetic element 310 and the spherical toy construction 110 being substantially axially aligned at the access hole 125 of the spherical toy construction 110. The outward-facing surface 359 of the recess 355 provides a good seat for the spherical toy construction 10 and contributes to a stable connection and frictional contact between the spherical surface 119 and the outward facing surface 359, thereby resisting movement. This permits the user to observe the light which emanates from the spherical toy construction 110, without any obstructions from the panel-shaped magnetic element 310.

Referring still to FIG. 8, additional toy constructions, either similar to or dissimilar from, the spherical toy construction 110 can be provided and attached directly to one or more of the magnets 363(*a*)-363(*g*). The panel-shaped magnetic element 310 may alternatively be provided without a magnet 363(*a*). In accordance with such an embodiment, the magnetic attraction between the magnetic nickel coating 117 of the spherical toy construction 110 and the magnets 363(*b*) and 363(*c*) can be sufficient to suspend the spherical toy construction 110 in the recess 355 such that the spherical toy construction 110 spins relatively freely about an axis drawn through the opposing magnets 363(*b*) and 363(*c*), such as through the axes of the opposing magnets.

It will be understood that the embodiments of the present invention described herein are merely exemplary and that a person skilled in the art may make many variations and modifications without departing from the spirit and scope of the invention. All such variations and modifications, including those discussed above, are therefore intended to be included within the scope of the present invention.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A toy construction kit comprising:

a light element comprising a housing having a first end and a second end, the housing defining a compartment, a magnet disposed in the compartment at the first end, a printed circuit board disposed at the second end of the housing, the printed circuit board having an illumination device mounted on its side opposite to the compartment, a transparent lens mounted over the printed circuit board, a receptacle shaped as a truncated sphere, the housing embedded within the receptacle, the truncated spherical receptacle defining a housing entry opening on its truncated side, and an access hole extending from an outer surface of the receptacle that is opposite to the truncated side, to the embedded housing; and a construction element held to the light element by a magnetic attractive force between the magnet at the first end of the light element and the construction element.

2. The toy construction kit of claim 1, the transparent lens having one of a cylindrical shape and a conical shape.

3. The toy construction kit of claim 1, the light element further comprising an electrical source in the compartment, the electrical source electrically isolated from the housing, and the electrical source disposed between and coupled to the printed circuit board and the magnet, the housing and the magnet being electrically conductive, such that an electrical path is defined from the electrical source to the printed circuit board, to the housing, to the magnet, and back to the electrical source.

4. The toy construction kit of claim 3, further comprising an electrically insulating sleeve in the compartment of the housing, the sleeve disposed between the electrical source and the housing.

5. The toy construction kit of claim 3, the housing comprising a first end portion and a second end portion, the first end portion connecting to the second end portion to electrically connect the first end of the housing to the second end of the housing.

6. The toy construction kit of claim 5, the first end portion and the second end portion joined by a threaded connection, electrical continuity between the first end portion and the second end portion being established when the first end portion is fully threaded to the second end portion.

7. The toy construction kit of claim 3, the printed circuit board having a first side on which the illumination device is mounted and a second side opposite to the first side, the second side having a conductive surface, the electrical source contacting the conductive surface of the printed circuit board, and the compartment having a conductive surface at the first end of the housing, the magnet contacting the conductive surface of the compartment.

8. The toy construction kit of claim 3, the electrical source comprising at least two batteries arranged in series.

9. The toy construction kit of claim 1, the housing comprising a non-magnetic material.

10. The toy construction kit of claim 1, the truncated spherical receptacle having a spherical outer surface and comprising a plastic core coated with magnetic nickel that is coextensive with the spherical outer surface of the receptacle.

11. The toy construction kit of claim 1, the receptacle defining a cylindrical recess, the housing being cylindrical, and the cylindrical recess and the housing being dimensioned so as to produce a friction fit between the housing and the receptacle when the housing is inserted into the cylindrical recess of the receptacle.

12. The toy construction kit of claim 1, the truncated sphere of the receptacle being greater than a hemisphere, the transparent lens shaped as a spherical sector that is less than a hemisphere, the housing embedded within the receptacle such that the transparent lens and the receptacle form a sphere, and the receptacle comprising a plastic core coated with magnetic nickel.

13. The toy construction kit of claim 12, the construction element comprising a bar-shaped magnetic element, the bar-shaped magnetic element comprising an elongated rod having a pocket at one end, and a magnet disposed in the pocket, the magnet of the bar-shaped magnetic element defining a first axis and the access hole defining a second axis, and the bar-shaped magnetic element coupled to the light element by magnetic attractive force between the magnet of the bar-shaped magnetic element and the magnetic nickel coating of the receptacle, such that the first axis of the magnet of the bar-shaped magnetic element is substantially perpendicular to the second axis of the access hole to laterally project light emanating from the illumination device.

14. The toy construction kit of claim 1, the truncated sphere of the receptacle being greater than a hemisphere, the transparent lens shaped as a spherical sector that is less than a hemisphere, and the housing embedded within the receptacle such that the transparent lens and the receptacle form a sphere.

15. The toy construction kit of claim 1, the construction element comprising a bar-shaped magnetic element, the bar-shaped magnetic element comprising an elongated rod having a pocket at one end, and a magnet disposed in the pocket, the bar-shaped magnetic element coupled to the light element by magnetic attractive force between the magnet of the bar-shaped magnetic element and the magnet of the light element, the magnet of the bar-shaped magnetic element defining a first axis, the magnet of the light element defining a second axis, and the first axis and the second axis being aligned, and the illumination device being located on a side of the light element opposite to the bar-shaped magnetic element.

16. The toy construction kit of claim 1, the construction element comprising a panel having a polygonal shape with at least three sides, a first major surface, and a second major surface opposite to the first major surface, a side of the at least three sides defining a partially circular recess, and the panel defining a pocket adjacent the recess, a magnet disposed in the pocket, the receptacle disposed in the partially circular recess, and the construction element coupled to the light element by magnetic attractive force between the magnet of the panel and the magnet of the light element.

17. The toy construction kit of claim 16, the magnet of the panel defining a first axis aligned with a center of the polygonal shape, the magnet of the light element defining a second axis aligned with the first axis, and the illumination device being located on a side of the light element opposite to the center of the polygonal shape.

18. The toy construction kit of claim 1, the truncated spherical receptacle having a spherical outer surface and comprising a plastic core coated with a ferromagnetic coating that is coextensive with the spherical outer surface of the receptacle, the construction element comprising a panel having a polygonal shape with at least three sides, a first major surface, and a second major surface opposite to the first major surface, a side of the at least three sides defining a partially circular recess, a first panel magnet disposed adjacent the recess, a second panel magnet disposed adjacent the recess on a side of the recess opposite to the first panel magnet, the first panel magnet and the second panel magnet defining an axis, the light element held in the partially circular recess by magnetic attractive force between the first panel magnet and the ferromagnetic coating of the receptacle and by magnetic attractive force between the second panel magnet and the ferromagnetic coating of the receptacle, such that the light element spins about the axis.

19. A light assembly removably attachable to a ferromagnetic element of a magnetic toy construction kit, the light assembly comprising:

an electrically conductive housing having a first end and a second end, the housing defining a compartment, the housing having an outer shell shaped as a sphere with a truncated side, the truncated spherical outer shell being greater than a hemisphere, and the truncated side corresponding to the second end;

an electrically conductive magnet disposed in the compartment at the first end;

a printed circuit board mounted over and coupled to the second end of the housing, the printed circuit board having a first side facing the compartment, a second side opposite to the first side, a conductive surface on the first side, and an illumination device mounted on the second side;

a transparent lens mounted over the second side of the printed circuit board and the truncated side of the housing, the transparent lens shaped as a spherical sector that is less than a hemisphere, such that the transparent lens and the receptacle form a sphere;

at least one battery disposed in the compartment and coupled to the magnet and the conductive surface of the printed circuit board; and an electrical insulator disposed between the at least one battery and the housing, wherein an electrical path is established from the at least one battery to the printed circuit board, to the housing, to the magnet, and back to the at least one battery.

20. The light assembly of claim 19, the housing defining an access hole extending from a location at the outer shell that is opposite to the truncated side, to the compartment at the first end of the housing.

21. A toy construction kit comprising:

a light element comprising a housing having a first end and a second end, the housing defining a compartment, a magnet disposed in the compartment at the first end, a printed circuit board disposed at the second end of the housing, the printed circuit board having an illumination device mounted on its side opposite to the compartment, a transparent lens mounted over the printed circuit board, and a receptacle shaped as a truncated sphere, the housing embedded within the receptacle, the truncated sphere of the receptacle being greater than a hemisphere, the transparent lens shaped as a spherical sector that is less than a hemisphere, and the housing embedded within the receptacle such that the transparent lens and the receptacle form a sphere; and a construction element held to the light element by a magnetic attractive force between the magnet at the first end of the light element and the construction element.

22. The light assembly of claim 21, the construction element comprising a bar-shaped magnetic element, the truncated spherical receptacle having a spherical outer surface and comprising a plastic core coated with magnetic nickel that is coextensive with the spherical outer surface of the receptacle, the bar-shaped magnetic element comprising an elongated rod having a pocket at one end, and a magnet disposed in the pocket, the magnet of the bar-shaped magnetic element defining a first axis and the magnet of the light element defining a second axis, and the bar-shaped magnetic element coupled to the light element by magnetic attractive force between the magnet of the bar-shaped magnetic element and the magnetic nickel coating of the receptacle, such that the first axis of the magnet of the bar-shaped magnetic element is substantially perpendicular to the second axis of the magnet of the light element, to laterally project light emanating from the illumination device.

* * * * *